US010263347B2

(12) United States Patent
Koto

(10) Patent No.: US 10,263,347 B2
(45) Date of Patent: Apr. 16, 2019

(54) CONNECTING STRUCTURE AND CONNECTING METHOD FOR ELECTRIC CABLES

(75) Inventor: Naoki Koto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 415 days.

(21) Appl. No.: 13/526,667

(22) Filed: Jun. 19, 2012

(65) Prior Publication Data

US 2012/0318576 A1 Dec. 20, 2012

(30) Foreign Application Priority Data

Jun. 20, 2011 (JP) ..... 2011-136601

(51) Int. Cl.
*H01R 4/00* (2006.01)
*H01R 4/62* (2006.01)
*H01R 4/72* (2006.01)

(52) U.S. Cl.
CPC ..... *H01R 4/625* (2013.01); *H01R 4/723* (2013.01)

(58) Field of Classification Search
CPC ..... H01R 4/625; H01R 4/723; H01R 4/00
USPC ..... 174/32, 88 R
See application file for complete search history.

(56) References Cited

U.S. PATENT DOCUMENTS 2,806,215 A * 9/1957 Redslob ..... 439/868
2,901,722 A * 8/1959 Arnott, Jr. ..... 439/203
2,967,795 A * 1/1961 Bollmeier et al. ..... 174/84 R
3,243,211 A * 3/1966 Wetmore ..... 403/28
3,354,258 A * 11/1967 Saia et al. ..... 174/557
3,417,195 A * 12/1968 Shlesinger, Jr. ..... 174/84 C
3,847,183 A * 11/1974 Meyer ..... 138/96 R
4,129,744 A * 12/1978 Cunningham et al. ..... 174/94 R
5,188,260 A * 2/1993 Bettinger ..... 222/95
2001/0003687 A1 6/2001 Kondo
2002/0027013 A1 3/2002 Kondo
(Continued)

FOREIGN PATENT DOCUMENTS

CN 2193599 Y 3/1995
JP 2001-167821 A 6/2001
JP 2002-43010 A 2/2002
(Continued)

OTHER PUBLICATIONS

Office Action dated Apr. 23, 2014, issued by the State Intellectual Property Office of the People's Republic of China in counterpart Chinese Application No. 201210209105.9.
(Continued)

*Primary Examiner* — Angel R Estrada
(74) *Attorney, Agent, or Firm* — Sughrue Mion, PLLC

(57) ABSTRACT

There is provided a connecting structure for electric cables. A first electric cable includes a first core and a first cover covering the first core. A portion of the first core is exposed from an end of the first cover. A second electric cable includes a second core made of a different metal from that of the first core and a second cover covering the second core. A portion of the second core is exposed from an end of the second cover. A tube is shrunk in a state where the tube accommodates thereinside the portion of the first core and the portion of the second core which are connected to each other. An inside of the tube except for the portion of the first core and the portion of the second core is filled with cured hot-melt.

7 Claims, 7 Drawing Sheets

(56) References Cited

U.S. PATENT DOCUMENTS

| | | | |
|---|---|---|---|
| 2002/0053458 | A1 | 5/2002 | Kondo |
| 2010/0282486 | A1 | 11/2010 | Shin et al. |

FOREIGN PATENT DOCUMENTS

| | | | | | |
|---|---|---|---|---|---|
| JP | 2004-207172 | A | | 7/2004 | |
| JP | 2005-102367 | A | | 4/2005 | |
| JP | 2007167677 | | * | 6/2007 | ..... H01R 4/62 |
| JP | 2008-176970 | A | | 7/2008 | |
| JP | 2009-9736 | A | | 1/2009 | |
| JP | 20099736 | A | | 1/2009 | |

OTHER PUBLICATIONS

Communication from the State Intellectual Property Office of P.R. China dated Sep. 30, 2014, in a counterpart application No. 201210209105.9.

Communication from the State Intellectual Property Office of P.R. China dated Apr. 9, 2015 in a counterpart Chinese application No. 201210209105.9.

Office Action dated Feb. 24, 2015 issued by the Japanese Patent Office in counterpart Japanese Patent Application No. 2011-136601.

Communication from the Korean Intellectual Property Office dated Apr. 9, 2015 in a counterpart Korean application No. 201210209105.9.

Office Action dated Aug. 18, 2015, issued by the Japanese Patent Office in counterpart Japanese Application No. 2011-136601.

* cited by examiner

CONNECTING STRUCTURE AND CONNECTING METHOD FOR ELECTRIC CABLES

The disclosure of Japanese Patent Application No. 2011-136601 filed on Jun. 20, 2011, including specification, drawings and claims is incorporated herein by reference in its entirety.

BACKGROUND

The present invention relates to a connecting structure and connecting method for electric cables, in which two electric cables made of heterogeneous metals are connected to each other so as to have a waterproof function.

Copper electric cables are widely used as electric cables for supplying power to houses or for the wiring of electronic devices, since copper electric cables have high electric conductivity, high rigidity relative to gold electric cables or aluminum electric cables and advantages in terms of mechanical strength and price. On the other hand, aluminum electric cables using aluminum or aluminum alloy as a conductor material are desirable when considering demand for the lightweight of vehicles, large amount of resource that ensures stable supply, recyclability that facilitates separation from steel, and the like.

Due to such desires, these days, such aluminum electric cables are widely used as electric cables for vehicles. Such an aluminum electric cable is electrically connected to a circuit device or the like through a terminal that is connected to a distal end of the aluminum electric cable. The terminal is made of copper or copper alloy having spring force by which the terminal can be in tight contact with a counterpart terminal. Since contact corrosion may be undesirably caused by contact of heterogeneous metals, when the aluminum electric cable is used, various measures for corrosion resistance are carried out for the terminal to be connected to the aluminum electric cable.

As for the electric cables for vehicles, the connection reliability between a copper electric cable and a terminal is ensured based on a performance evaluation including an endurance test and data that has been accumulated during actual driving. However, when the aluminum electric cable instead of the copper electric cable is connected to the terminal as described above, massive amounts of time and cost are consumed because the optimization of press-contact conditions, the verification of connection reliability, the optimization of a terminal structure, and the like must be performed.

Therefore, there is a technology for connecting the aluminum electric cable to the terminal made of copper or copper alloy without performing the optimization of press-contact conditions, the verification of connection reliability, the optimization of a terminal structure, and the like. A related-art connecting structure for electric cables, that prevents the contact corrosion in the connection portion between the terminal and the aluminum electric cable is presented by, for example, Patent Document 1. In the related-art connecting structure, by connecting a short copper electric cable between the terminal and the aluminum electric cable, it is possible to avoid the connection between heterogeneous metals in the terminal to prevent contact corrosion.

As shown in FIG. 7, in the related-art connecting structure for electric cables, one end of a conductor 34 of a short copper electric cable 36 which is formed by covering the conductor 34 made of copper or copper alloy with an insulator 35 is connected to a conductor terminal of an aluminum electric cable 33 which is formed by covering a conductor 31 made of aluminum or aluminum alloy with an insulator 32, and the connected portion is covered with an insulator 37. In addition, in the related-art connecting structure for electric cables, a terminal 38 made of copper or copper alloy is connected to the other end of the conductor 34 of the copper electric cable 36 by press-contact connection.

According to the related-art connecting structure, since the copper electric cable 36 is press-contacted to the terminal 38 made of copper or copper alloy, there is no danger that contact corrosion due to the contact of heterogeneous metals might occur in an electric cable press-contact section. In addition, in the electric cable press-contact section, it is possible to ensure high connection reliability by utilizing the performance evaluation and the result of the actual use of terminals that have been cultivated to date. Along with this, in the terminal press-contact section, it is possible to reduce massive amount of time and cost that is consumed for the optimization of press-contact conditions, the verification of connection reliability, the optimization of terminal structure, and the like. In addition, since the connection portion between the aluminum electric cable 33 and the copper electric cable 36 is covered with the insulator 37, it is possible to prevent water, vapor or the like from entering into the connection portion from the outside, thereby suppressing the foregoing occurrence of contact corrosion between heterogeneous metals.

Patent Document 1: Japanese Patent Application Publication No. 2009-009736

The connecting structure for electric cables according to the related art has the following problems to be solved.

Since the terminal or the short copper electric cable connected to the terminal is not waterproof, when an engine room of a vehicle or the like is cleaned in the state in which the connection portion is not sufficiently covered with an insulator, for example, a drop of water attached to the aluminum electric cable may permeate to a terminal in the electronic circuit side or to the electronic circuit through the connection portion between the aluminum electric cable and the copper electric cable due to a capillary phenomenon, and is attached to the connection portion between the aluminum electric cable and the copper electric cable, thereby causing the foregoing contact corrosion between heterogeneous metals to occur. In particular, when the copper electric cable or the aluminum electric cable is a strand produced by twisting or braiding a plurality of cores together, a drop of water, which permeated into a gap between the cores of the aluminum and copper electric cables or between the cores and the insulating cover, accelerates contact corrosion in the connection portion.

SUMMARY

It is thereof an object of the present invention is to provide a connecting structure and connecting method for electric cables, in which gaps between cores of electric cables and between the cores and an insulated cover can be made waterproof using a simple structure and in a simple operation.

According to a first aspect of the embodiments of the present invention, there is provided a connecting structure for electric cables, comprising: a first electric cable including a first core and a first cover covering the first core, wherein a portion of the first core is exposed from an end of the first cover; a second electric cable including a second core made of a different metal from that of the first core and a second cover covering the second core, wherein a portion of the second core is exposed from an end of the second cover; and a tube which is shrunk in a state where the tube accommodates thereinside the portion of the first core and the portion of the second core which are connected to each other, wherein an inside of the tube except for the portion of the first core and the portion of the second core is filled with cured hot-melt.

In the first aspect, when the tube is shrunk, the hot-melt applied on the inner surface of the tube, or the hot-melt applied to the portion of the first core and the portion of the second core is permeated to the portion of the cores and the region except for the portion (continuous to the portion) and is solidified. The gaps between the wires of each core and between the wires and the first and second covers in the respective potion are closed, thereby producing a waterproof function. Such a waterproof structure can prevent a drop of water (moisture) from entering into the gap adjacent to the connection portion between the first core and the second core, thereby preventing the contact corrosion from occurring in the connection portion between the heterogeneous metals. In addition, even if a terminal is connected to the other region of one of the cores, moisture is prevented from moving from the other one of the cores to that terminal. Therefore, it is possible to prevent an insulation defect in the terminal connection portion.

According to a second aspect of the embodiments of the present invention, there is provided a connecting method for electric cables, comprising: connecting a portion of a first core which is exposed from an end of a first cover and a portion of a second core which is made of a different metal from that of the first core and exposed from an end of a second cover; accommodating the portion of the first core and the portion of the second core together with molten hot-melt inside a tube; and shrinking the tube.

In the second aspect, at the connecting step, it is possible to mechanically connect the first core and the second core to each other via ultrasonic welding, cold welding, soldering, or the like. At the accommodating step, it is possible to cover the connection portion between the first and second cores by moving the tube, which is fitted on the first or second cover in advance, so that the first and second cores are surrounded. In addition, at the accommodating step, the melting of the hot-melt, which is applied on the inner surface of the tube or is applied in advance on the outer circumference of the cores adjacent to the connection portion, and the heat shrinking of the tube are performed at the same time. Thus, in the portion of the first core, the portion of the second core, and the other regions continuous to these portions, the molten hot-melt permeates to the gaps between the wires of each core and between the wires and the first and second covers. As a result, the connection portion between the first and second cores is imparted with a waterproof function by the hot-melt, which is solidified later. The effect of preventing the contact corrosion in this connection portion can be obtained.

The accommodating may include: applying the molten hot-melt on an inner surface of the tube; and accommodating the portion of the first core and the portion of the second core inside the tube with the inner surface thereof being applied with the molten hot-melt.

After the portion of the first core and the portion of the second core are accommodated inside the tube, on the inner surface of the tube the hot-melt is applied in advance, when the tube is shrunk while the hot-melt is being melted, the hot-melt is subjected to the shrinking force of the tube, thereby smoothly and rapidly permeating to the gaps between the wires of each core and between the wire and the first and second covers. Therefore, the connection portion between the first and second cores is imparted with a sufficient waterproof function, and it is possible to prevent contact corrosion from occurring in the connection portion between the heterogeneous metals.

The accommodating may include: applying the molten hot-melt on the portion of the first core and the portion of the second core; and accommodating the portion of the first core and the portion of the second core, on which the molten hot-melt is applied, inside the tube.

It is possible to melt the hot-melt while shrinking the tube by moving the tube, which was fitted on the first or second cover in advance, to the position where the connection portion between the first and second cores is covered, so that a portion of the first core and a portion of the second core on which the hot-melt are accommodated inside the tube, and overheating the tube. The shrinking force of the tube can make the hot-melt smoothly and rapidly permeate to the gaps between the wires of each core and between the wires and the first and second covers. Accordingly, it is possible to process the connection portion between the first and second cores so as to be waterproof as described above without the process of applying the hot-melt on the inner surface of the tube.

According to the connecting structure and connecting method for electric cables according to the present invention, the gaps between the wires of each core of the electric cables and between the wires and each cover can be made waterproof using a simple structure and in a simple operation.

BRIEF DESCRIPTION OF THE DRAWINGS

In the accompanying drawings:

FIG. 4A to FIG. 4F illustrate each process;

FIG. 6A to FIG. 6F illustrate each process.

DETAILED DESCRIPTION OF THE EMBODIMENTS

Hereinafter, a connecting structure for electric cables according to an embodiment of the present invention will be described with reference to FIG. 1 to FIG. 6F.

Figure 1:
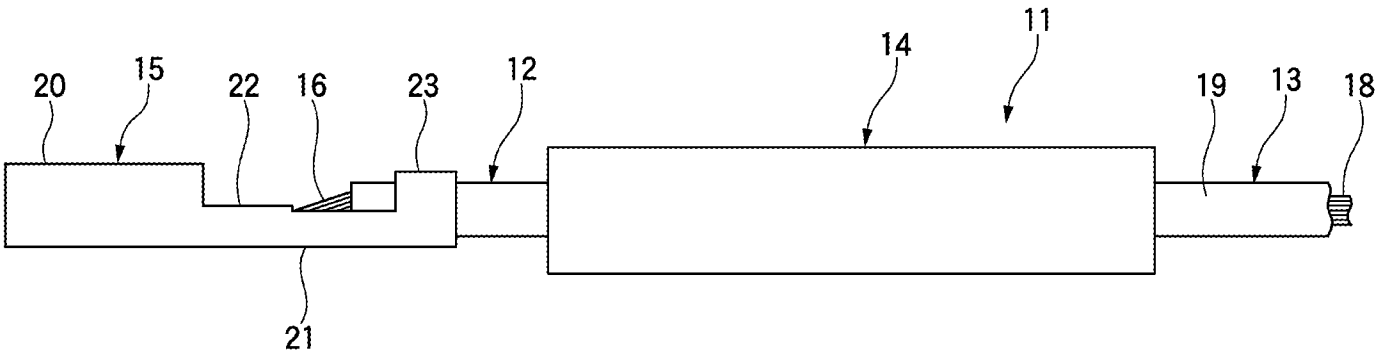
FIG. 1 is a front view conceptually illustrating a connecting structure for electric cables according to the present invention.

As shown in FIG. 1, the connecting structure for electric cables according to this embodiment is a connecting structure for electric cables W, which is connected to, for example, an electronic control circuit. This structure directly connects a terminal to a copper electric cable, which is made of the same material as the terminal, by interposing the copper electric cable between the terminal made of copper or copper alloy and an aluminum electric cable. This makes it possible to avoid contact corrosion from occurring at a region (connection portion) where the terminal and the copper electric cable are connected to each other. Therefore, at the connection portion between the terminal and the aluminum electric cable, the occurrence of contact corrosion due to the presence of moisture as in the related art can be avoided. In addition, subsequent electrical and mechanical problems (e.g. an increase in electrical resistance or a decrease in the strength of connection due to the creation of rust) can also be avoided.

In order to obtain such effects, in this embodiment, gaps between wires of each core and between the wires and an insulating sheath (cover) adjacent to the connection portion between the copper electric cable and the aluminum electric cable are made waterproof using hot-melt, thereby making it possible to avoid contact corrosion in the connection portion between the copper electric cable and the aluminum electric cable, and control movement of moisture from the aluminum electric cable side to the copper electric cable side and further to the terminal. Hereinafter, the connecting structure for electric cables according to this embodiment will be described in detail.

Figure 2:
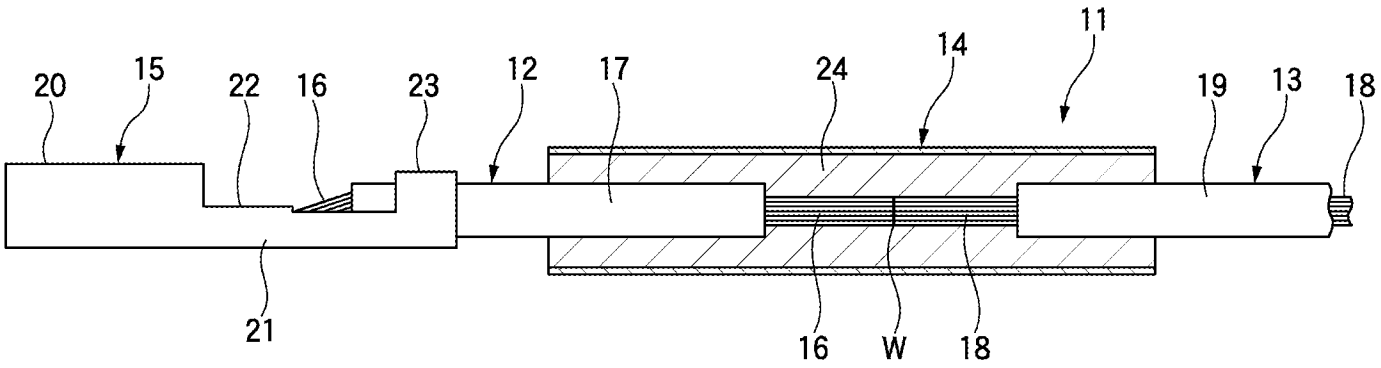
FIG. 2 is a front view illustrating the connecting structure for electric cables shown in FIG. 1, where the connecting structure is partially cut away.

Referring to FIG. 1 and FIG. 2, the connecting structure for electric cables 11 is constructed by assembling a first electric cable (hereinafter, referred to as a copper electric cable) 12, a second electric cable (hereinafter, referred to as an aluminum electric cable) 13, a tube (hereinafter, referred to as a heat-shrink tube) 14, and a terminal 15. Among them, the copper electric cable 12, i.e. the first electric cable, is constructed by covering a first core 16 made of a plurality of wires, which are twisted or braided together, with an insulating sheath (hereinafter, referred to as a first outer cover) 17, and extends a predetermined length so as to be connectable between the terminal 15 and the aluminum electric cable 13. In the copper electric cable 12, both ends of the first core 16 are exposed from the first cover 17 by stripping both ends of the first cover 17 to a predetermined length. In this copper electric cable 12, each gap between the wires of the first core 16 or between the wires and the first cover 17 is a gap through which water or gas can flow.

The aluminum electric cable 13, i.e. the second electric cable, is constructed by covering a second core 18, which is made by twisting or braiding a plurality of wires together, with an insulating cover (hereinafter, referred to as a second cover) 19 made of vinyl chloride or the like. In the aluminum electric cable 13, one end of the second core 18 is exposed by a predetermined length from the second cover 19 by stripping one end of the second cover 19 to a predetermined length. In this aluminum electric cable 13, each gap between the wires of the second core 18 or between the wires and the second cover 19, i.e. the insulating cover, is a gap through which water or gas can flow.

The first core 16 is made of copper or copper alloy, and the second core 18 is made of aluminum or aluminum alloy. The cores 16 and 18 are connected to each other by press-contact. This press-contact connection is realized by, for example, directing a welding horn toward a region where respective ends of the cores 16 and 18 are tied together on an anvil (not shown), followed by high-frequency oscillation, so that frictional heat is generated between the cores 16 and 18. In addition, in a cold welding connecting method, connecting is carried out by fitting corresponding ends of the cores 16 and 18 into holes of dice so as to butt to each other, and then pressing the butted section sliding the dice.

In addition, the terminal 15 is realized by punching (pressing) a plate made of copper or copper alloy, followed by bending the plate. A connection portion 20, which has the shape of an angled box or a cylinder, is provided on the leading end side, which is connected to a counterpart terminal, and a press-contact section 21, which connects the first core 16 by press-contact, extends from the base end of the connection portion 20. The press-contact section 21 includes a pair of electric cable barrels 22, which connects one end of the first core 16 by press-contact, and a pair of outer cover barrel 23, which press-contact the first outer cover 17. The press-contact section 21 is connected to the terminal of the copper electric cable 12 by crimping the first core 16 and the first outer cover 17. The shape of the terminal 15 is not specifically limited, and may be of any one of a female terminal and a male terminal.

The connection between the terminal 15 and the copper electric cable 12 is enabled by crimping, which is typically performed. Instead of an aluminum electric cable as an electric cable that is connected to the terminal 15, the copper electric cable 12, which has proved connection reliability due to massive performance evaluation and the result of use. Thus, high-reliability connection is possible based on the result that has been accumulated to dates. In addition, since additional massive performance evaluation, test, or the like is not necessary, it is possible to reduce the cost of development and is advantageous in terms of cost.

Figure 3:
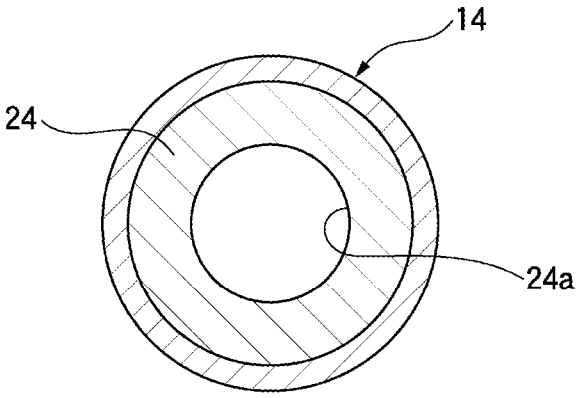
FIG. 3 is a longitudinal cross-sectional view illustrating the tube used for connecting the electric cables in FIG. 1.

In order to accommodate (cover) a portion of the first core 16 (a portion that is exposed from the first cover 17) and a portion of the second core 18 (a portion that is exposed from the second cover 19), which are connected as described above, the heat-shrink tube 14 is disposed around the first cover 17 of the copper electric cable 12 and the second cover 19 of the aluminum electric cable 13, with hot-melt 24 being interposed therebetween. The heat-shrink tube 14 is a tube that self-shrinks when heat is applied thereto. As shown in FIG. 3, hot-melt 24 having a predetermined thickness is applied in advance. Thus, it is possible to shrink the heat-shrink tube 14 while melting the hot-melt 24 by applying heat to the heat-shrink tube 14, which is fitted in advance around any one of the copper electric cable 12 and the aluminum electric cable 13, from the outside.

In this case, due to the shrinking force of the heat-shrink tube 14, it is possible to make the molten hot-melt 24 permeate between a portion of the first core 16 and a portion of the second core 18, between the wires of each core 16, 18 except for these portions, and furthermore into the gaps between the wires and the first and second covers 17 and 19. When the hot-melt 24 is cured, the hot-melt 24 has a waterproof function. The hot-melt 24 cures by reacting with moisture (humidity) in the air after being heated and melted using, for example, polyurethane-based uncured resin as a major component. In addition, the heat-shrink tube 14 has a property of shrinking generally in the diameter direction when heat is applied thereto, and uses polyolefins, fluorine-based polymer, thermoplastic elastomer, or the like as a material.

Therefore, in the connecting structure for electric cables 11, when drops of water are attached to the connection portion between the terminal 15 made of copper or copper alloy and the core (made of copper or copper alloy) of the copper electric cable, this connection portion is not subjected to contact corrosion because the terminal 15 and the core are made of the same metal. In contrast, the connection portion between the first core 16 of the copper electric cable 12 and the second core 18 of the aluminum electric cable 13 is a connection between heterogeneous metals, and thus is in the danger that corrosion resistance may be caused by drops of water that are attached thereto.

However, according to this embodiment, waterproof ability is realized since the hot-melt 24 sufficiently permeates to the connection portion between a portion of the first core 16 of the copper electric cable 12 and a portion of the second core 18 of the aluminum electric cable 13, to the gap between the first core 16 and the first cover 17 at one end of the first cover 17, and to the gap between the second core 18 and the second cover 19 at one end of the second cover 19. Due to this, it is possible to avoid moisture from being attached to the connection portion, so that contact corrosion does not occur in the connection portion. Here, the hot-melt 24, which is applied on the inner surface of the heat-shrink tube 14, is provided in an amount (thickness) that can be filled, so as to be filled between the wires of each core 16, 18 and in the gaps between the wires and the covers 17 and 19 without being excessive or insufficient.

In this way, this embodiment does not apply the anti-corrosion structure for electric cables to the connection portion between the terminal 15 and the aluminum electric cable 13, which has a complicated structure, unlike the related art. Rather, this embodiment uses the anti-corrosion structure in the connection portion between the copper electric lien 12 and the aluminum electric cable 13, in which connection processing and repair are easy. Although the connecting structure for electric cables according to this embodiment is embodied in order to obtain anti-corrosion effect at the connection portion between the copper electric cable 12 and the aluminum electric cable 13, i.e. the heterogeneous metals, this can also be used in order to obtain waterproof effect at the connection portion between copper electric cables or between aluminum electric cables.

A description will be given below of the sequence of connecting electric cables.

(Connecting Sequence 1)

First, the copper electric cable 12 to be connected to the terminal 15 is prepared. The copper electric cable 12 is short, as shown in FIG. 2. However, the copper electric cable 12 is preferably set to a predetermined length so as to support the heat-shrink tube 14, which is fitted thereon. The copper electric cable 12 is connected and interposed between the terminal 15 and the aluminum electric cable 13. The terminal 15 may be preferably connected to one end of the copper electric cable 12 in advance or after the heat-shrink tube 14 is mounted.

Figure 4A:
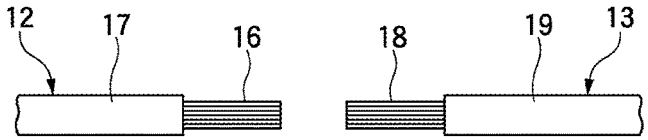
FIGS. 4A to 4F are process diagrams illustrating a sequence of assembling the connecting structure for electric cables shown in FIG. 1, where
Figure 4B:
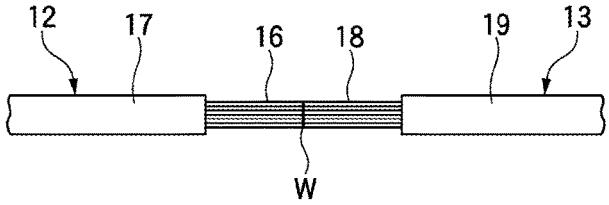

In sequence, the leading end of the first core 16 that is exposed from the first cover 17 of the copper electric cable 12, i.e. the first electric cable, and the leading end of the second core 18 that is exposed from the second cover 19 are set so as to concentrically oppose each other, as shown in FIG. 4A. In addition, the opposing leading ends of the first core 16 and the second core 18 are butted to each other, and as shown in FIG. 4B, the opposing leading ends of the first core 16 and the second core 18 are connected together via cold welding as described above.

Figure 4C:
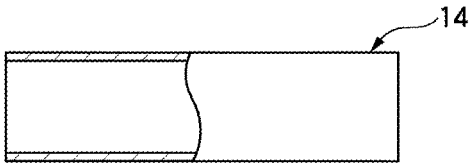

Afterwards, the heat-shrink tube 14 shown in FIG. 4C is prepared. The heat-shrink tube 14 has a property of reducing and narrowing in the diameter direction when heat is applied from the outside. The heat-shrink tube 14 has a length that includes a predetermined length of one end of the first cover 17 in the copper electric cable 12 and a predetermined length of one end of the second cover 19 in the aluminum electric cable 13, which oppose each other, and is shaped such that it can surround a portion of the first core 16 and a portion of the second core 18, which are connected to each other, from the surrounding. In addition, the inner diameter of the heat-shrink tube 14 is greater than the outer diameter of the first cover 17 and the second cover 19.

Figure 4D:
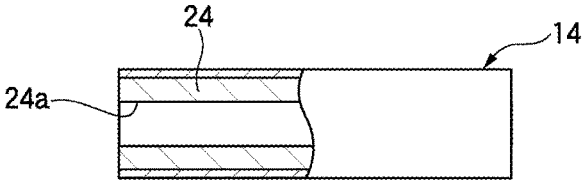
Figure 4E:
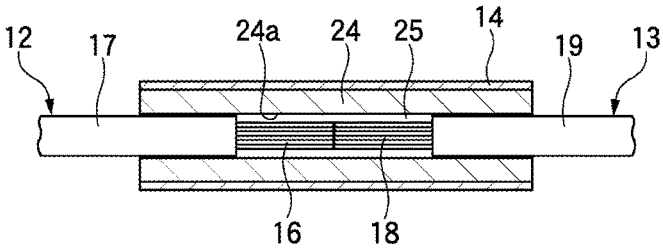

On the inner surface (inner circumference) of the heat-shrink tube 14, the hot-melt 24 shown in FIG. 4D is applied. The thickness of the hot-melt 24 is set to a size such that the hot-melt 24 permeates to the gaps between the wires of the first core 16, between the wires and the first cover 17, between the wires of the second core 18, and between the wires and the second cover 19, thereby filling the gaps without being excessive or insufficient. The inner circumference of the center hole 24*a* formed by the hot-melt 24 is set to be slightly greater than the outer size of the copper electric cable 12 and the aluminum electric cable 13, such that the copper electric cable 12 and the aluminum electric cable 13 can be smoothly inserted into the first cover 17 and the second cover 19.

In addition, the heat-shrink tube 14 on which the hot-melt 24 is applied has a through-hole so as to cover the first core 16, the second core 18, one end of the first cover 17, and one end of the second cover 19 that is opposite one end of the first cover 17 across a predetermined length. In the process shown in FIG. 4E, the hot-melt 24 is not yet melted, and thus a space 25 is maintained between the first core 16 and the second core 18, which are exposed from the first cover 17 and the second cover 19.

Figure 4F:
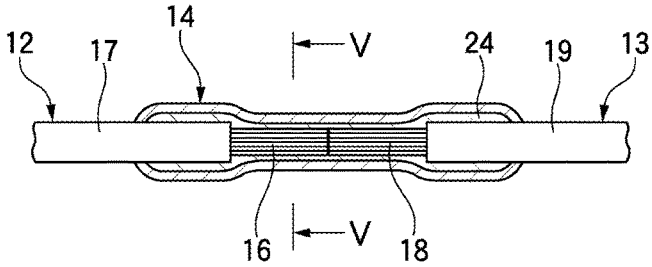

After that, when the heat-shrink tube 14 is heated by, for example, blowing hot wind from the outside of the heat-shrink tube 14, the heat-shrink tube 14 shrinks generally in the diameter direction, as shown in FIG. 4F. At the same time, the hot-melt 24 applied on the inner surface of the heat-shrink tube 14 starts to melt. Then, the viscosity of the hot-melt 24 gradually decreases due to this melting, and the hot-melt 24 starts to flow not only to the outer circumference of the first cover 17 and the second cover 19, which are surrounded by the heat-shrink tube 14, but also to the outer circumference of the first core 16 and the second core 18, which are exposed from the covers 17 and 19.

In addition, as the molten hot-melt 24 is under the shrinking force of the heat-shrink tube 14, the molten hot-melt 24 starts to permeate between the plurality of wires of the first core 16, between the plurality of wires of the second core 18, and further into the gaps between the wires of each core 16, 18 and the first and second covers 17 and 19. Since the hot-melt 24, which is applied on the inner surface of the heat-shrink tube 14, is set to a predetermined sufficient thickness (amount), it permeates at a sufficient density into the region of the first core 16 except for the above-described portion and the region of the second core 18 except for the above-described portion, without leaving a gap.

Figure 5:
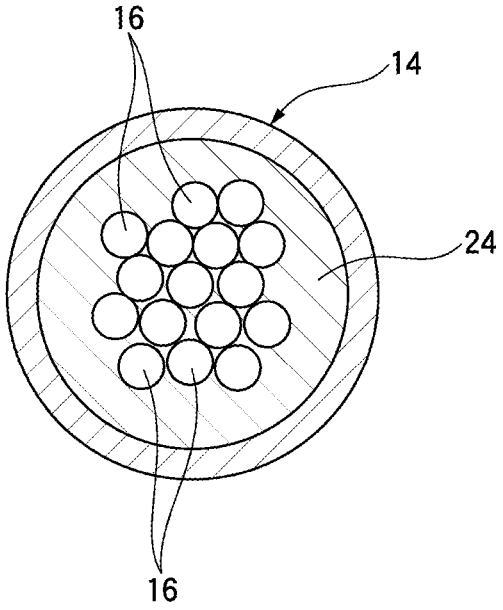
FIG. 5 is a cross-sectional view taken along a line V-V of the electric cable illustrated in FIG. 4F.

When the hot-melt 24 is solidified after having sufficiently permeated, the gaps are closed by the hot-melt 24, as shown in FIG. 5, so that the connection portion between the copper electric cable 12 and the aluminum electric cable 13 is in the waterproof state. Therefore, it is possible to prevent contact corrosion from occurring at the connection portion between the copper electric cable 12 and the aluminum electric cable 13, and to control drops of water from flowing (moving) from the aluminum electric cable 13 to the copper electric cable 12, thereby preventing contact corrosion from occurring in the terminal 15 as well as an increase in electrical resistance due to the deterioration of insulation or the production of nest.

(Connecting Sequence 2)

First, as in the connecting sequence 1, the copper electric cable 12 to be connected to the terminal 15 is prepared. Although the copper electric cable 12 is short as shown in FIG. 2, the copper electric cable 12 is preferably set to a predetermined length so as to support the heat-shrink tube 14, which is fitted thereon. The copper electric cable 12 is connected and interposed between the terminal 15 and the aluminum electric cable 13. The terminal 15 may be preferably connected to one end of the copper electric cable 12 in advance or after the heat-shrink tube 14 is mounted.

Figure 6A:
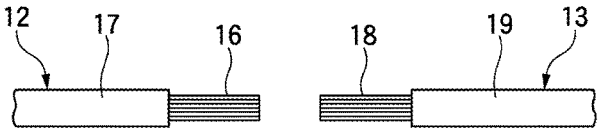
FIGS. 6A to 6F are another process diagrams illustrating a sequence of assembling the connecting structure for electric cables shown in FIG. 1, where
Figure 6B:
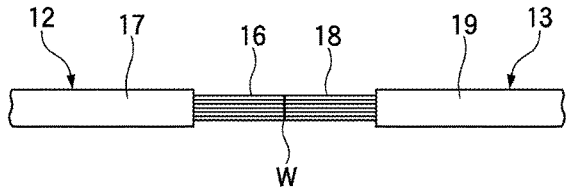

In sequence, the leading end of the first core 16 that is exposed from the first cover 17 and the leading end of the second core 18 that is exposed from the second cover 19 are set so as to concentrically oppose each other, as shown in FIG. 6A. In addition, the opposing leading ends of the first core 16 and the second core 18 are butted to each other, and as shown in FIG. 6B, are bonded together via cold welding as described above.

Figure 6C:
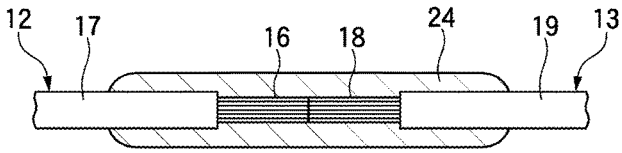

Afterwards, as shown in FIG. 6C, the hot-melt 24 is applied to a predetermined thickness (amount) on a region having a predetermined length that is adjacent to the connection portion between the first core 16 and the second core 18, the region including a portion of the first cover 17 and a portion of the second cover 19, and a portion of the outer circumference of the first and second cores 16 and 18, which are exposed from the first and second covers 17 and 19. The thickness of the hot-melt 24 is set to a size such that the hot-melt 24 is melted by heat and permeates to the gaps between the wires of the first core 16, between the wires and the first cover 17, between the wires of the second core 18, and between the wires and the second cover 19, thereby filling the gaps without being excessive or insufficient.

Figure 6D:
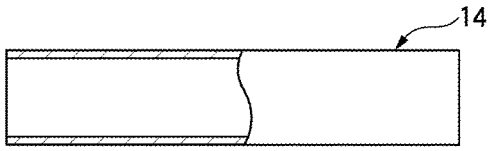

Afterwards, the heat-shrink tube 14 shown in FIG. 6D is prepared. The heat-shrink tube 14 has a property of reducing and narrowing in the diameter direction when heat is applied from the outside. The heat-shrink tube 14 has a length that includes a predetermined length of one end of the first cover 17 in the copper electric cable 12 and a predetermined length of one end of the second cover 19 and in the aluminum electric cable 13, which oppose each other, and is shaped such that it can surround a portion of the first core 16 and a portion of the second core 18, which are connected to each other, from the surrounding. The inner diameter of the heat-shrink tube 14 is set such that the heat-shrink tube 14 can be fitted around the hot-melt 24 with a gap therefrom. Here, the heat-shrink tube 14 is fitted around the first cover 17 or the second cover 19 in advance before the first core 16 and the second core 18 are connected to each other.

Figure 6E:
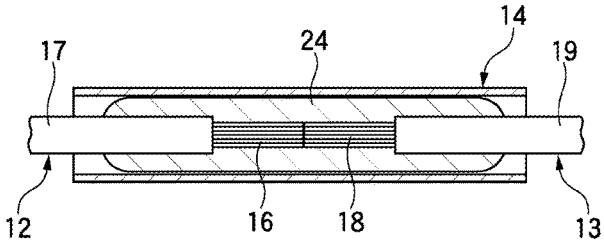

Afterwards, the heat-shrink tube 14 is moved along the first cover 17 or the second cover 19 so that it fitted as shown in FIG. 6E so as to surround the entire length of the hot-melt 24.

Figure 6F:
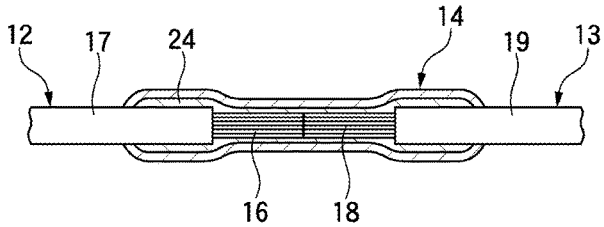
Figure 7:
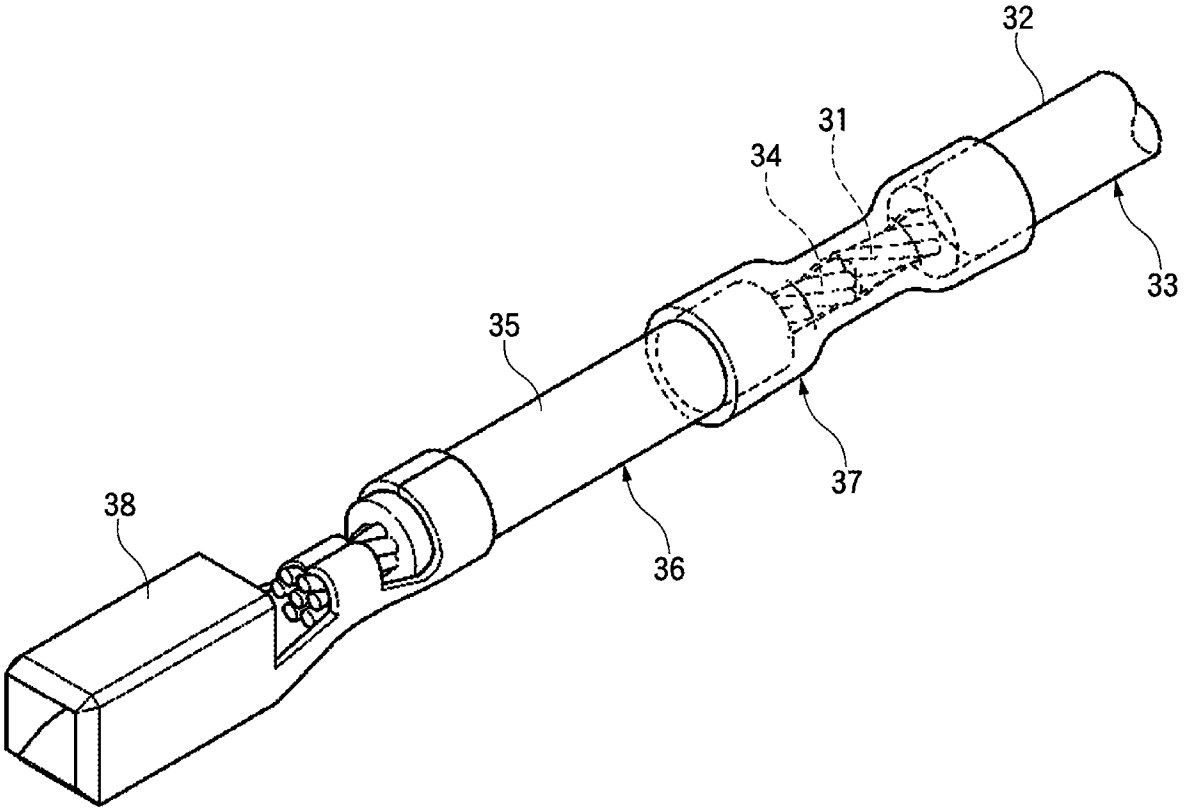
FIG. 7 is a perspective view illustrating a connecting structure for electric cables according to the related art.

After that, when the heat-shrink tube 14 is heated by blowing hot wind from the outside of the heat-shrink tube 14, the heat-shrink tube 14 shrinks generally in the diameter direction, as shown in FIG. 6F. At the same time, the hot-melt 24 applied on the inner surface of the heat-shrink tube 14 melts. Then, the viscosity of the hot-melt 24 gradually decreases due to this melting, and the hot-melt 24 starts to flow not only to the outer circumference of the first cover 17 and the second cover 19, which are surrounded by the heat-shrink tube 14, but also to the outer circumference of the first core 16 and the second core 18, which are exposed from the covers 17 and 19.

In addition, as the molten hot-melt 24 is under the shrinking force of the heat-shrink tube 14, the molten hot-melt 24 permeates between the plurality of wires of the first core 16, between the plurality of wires of the second core 18, and further into the gaps between the wires of each core 16, 18 and the first and second covers 17 and 19. Since the thickness of the hot-melt 24 is set to a predetermined size, it sufficiently permeates into the region of the first core 16 except for the above-described portion and the region of the second core 18 except for the above-described portion, without leaving a gap.

After the hot-melt 24 has permeated, the hot-melt 24 is solidified. As shown in FIG. 5, the gaps are closed by the hot-melt 24, so that the connection portion between the copper electric cable 12 and the aluminum electric cable 13 is in the waterproof state. Therefore, it is possible to prevent contact corrosion from occurring at the connection portion between the copper electric cable 12 and the aluminum electric cable 13, and to regulate drops of water from flowing (moving) from the aluminum electric cable 13 to the copper electric cable 12, thereby preventing contact corrosion from occurring in the terminal 15 as well as an increase in electrical resistance due to the deterioration of insulation or the production of rust.

As set forth above, according to the connecting structure and connecting method for connecting electric cables of this embodiment, it is possible to impart a waterproof structure to the gaps between the wires of each core 16, 18 and between the wires and the first and second covers 17 and 19 by allowing the hot-melt 24 to permeate to the region inside the heat-shrink tube 14, which is shrunk with a portion of the connected first and second cores 16 and 18 being accommodated therein, except for a portion of the first and second cores 16 and 18, and then curing the hot-melt. This waterproof structure makes it possible to prevent the contact corrosion from occurring in the connection portion, since drops of water (moisture) do not enter the surrounding of the connection portion between the first core 16 and the second core 18. This effect can be simply obtained using the melting of the hot-melt 24 and the shrinking force of the heat-shrink tube 14.

What is claimed is:

1. A connecting structure for electric cables, comprising:

a first electric cable including a first core made of a plurality of wires and a first cover covering the first core, wherein a portion of the first core is exposed from an end of the first cover;

a second electric cable including a second core made of a plurality of wires and made of a different metal from that of the first core and a second cover covering the second core, wherein a portion of the second core is exposed from an end of the second cover; and a tube which is shrunk in a state where the tube accommodates thereinside the portion of the first core and a portion of the second core which are connected to each other, wherein an inside of the tube being filled with cured hot-melt, the cured hot-melt being located at least between the plurality of wires in the first and second core and between the first and second cover and the first and second core respectively, wherein a hot-melt has a predetermined thickness before being heated such that the cured hot-melt permeates to the gaps between the wires of the first core, between the wires and the first cover, between the wires of the second core, and between the wires and the second cover without excess or insufficient hot-melt, wherein the hot-melt does not permeate a connection portion between the first core and the second core such that the first core and the second core remain electrically connected after the hot-melt has cured wherein the tube comprises an amount of the hot melt therein such that, prior to being shrunk in the state, the thickness of the hot-melt from the inside of the tube to an inside of the hot-melt is greater than a thickness of the tube.

2. A connecting method for electric cables, comprising:

connecting a portion of a first core made of a plurality of wires which is exposed from an end of a first cover and a portion of a second core made of a plurality of wires and which is made of a different metal from that of the first core and exposed from an end of a second cover;

accommodating the portion of the first core and the portion of the second core together with molten hot-melt inside a tube; and shrinking the tube, wherein an inside of the tube being filled with cured hot-melt, the cured hot-melt being located at least between the plurality of wires in the first and second core and between the first and second cover and the first and second core respectively, wherein a hot-melt has a predetermined thickness before being heated such that the cured hot-melt permeates to the gaps between the wires of the first core, between the wires and the first cover, between the wires of the second core, and between the wires and the second cover without excess or insufficient hot-melt, wherein the hot-melt does not permeate a connection portion between the first core and the second core such that the first core and the second core remain electrically connected after the hot-melt has cured, and wherein the tube comprises an amount of the hot melt therein such that, prior to being shrunk in the state, the thickness of the cured hot-melt from the inside of the tube to an inside of the hot-melt is greater than a thickness of the tube.

3. The connecting method according to claim 2, wherein the accommodating includes:

applying the molten hot-melt on an inner surface of the tube; and accommodating the portion of the first core and the portion of the second core inside the tube with the inner surface thereof being applied with the molten hot-melt.

4. The connecting method according to claim 2, wherein the accommodating includes:

applying the molten hot-melt on the portion of the first core and the portion of the second core; and accommodating the portion of the first core and the portion of the second core, on which the molten hot-melt is applied, inside the tube.

5. The connecting method according to claim 2, wherein the tube has two distal ends and a middle portion, wherein the middle portion has smaller diameter than a diameter at each distal end.

6. The connecting method according to claim 2, wherein the tube comprises the amount of the hot melt therein such that, prior to being shrunk in the state, the thickness of the hot-melt from the inside of the tube to the inside of the hot-melt is greater than double thickness of the tube.

7. The connecting method according to claim 2, wherein the thickness of the cured hot-melt is evenly applied along a length of the inside of the tube from one axial end of the tube to an opposite axial end of the tube.

* * * * *